US011200778B1

(12) United States Patent
Goldman et al.

(10) Patent No.: US 11,200,778 B1
(45) Date of Patent: Dec. 14, 2021

(54) GAMING SYSTEM HAVING AN INTERACTIVE ATTRACT MODE FOR PROMOTING GAME USE

(71) Applicant: GAMECO LLC, Las Vegas, NV (US)

(72) Inventors: Blaine Graboyes Goldman, Upper Black Eddy, PA (US); Mark C. Nicely, Daly City, CA (US); Eli Weissman, Las Vegas, NV (US); Anthony Litton, Las Vegas, NV (US); Jared Torres, Las Vegas, NV (US)

(73) Assignee: GAMECO LLC, Las Vegas, NV (US)

( * ) Notice: Subject to any disclaimer, the term of this patent is extended or adjusted under 35 U.S.C. 154(b) by 0 days.

(21) Appl. No.: 16/773,972

(22) Filed: Jan. 27, 2020

Related U.S. Application Data

(60) Provisional application No. 62/797,220, filed on Jan. 26, 2019.

(51) Int. Cl.
*G07F 17/34* (2006.01)
*G07F 17/32* (2006.01)

(52) U.S. Cl.
CPC ..... *G07F 17/3255* (2013.01); *G07F 17/3209* (2013.01); *G07F 17/3213* (2013.01); *G07F 17/3267* (2013.01); *G07F 17/3295* (2013.01); *G07F 17/3239* (2013.01); *G07F 17/3258* (2013.01); *G07F 17/34* (2013.01)

(58) Field of Classification Search
CPC ..... G07F 17/3255; G07F 17/3209; G07F 17/3213; G07F 17/3267; G07F 17/3295; G07F 17/3239; G07F 17/3258; G07F 17/34
See application file for complete search history.

(56) References Cited

U.S. PATENT DOCUMENTS

| | | | |
|---|---|---|---|
| D368,936 | S | 4/1996 | Goto |
| 5,570,885 | A | 11/1996 | Ornstein |
| D382,603 | S | 8/1997 | Goto |
| D393,290 | S | 4/1998 | Goto |
| D393,885 | S | 4/1998 | Goto |
| D393,886 | S | 4/1998 | Goto |
| D397,164 | S | 8/1998 | Goto |
| D398,032 | S | 9/1998 | Goto |
| D402,317 | S | 12/1998 | Goto |
| D405,120 | S | 2/1999 | Goto |
| D405,835 | S | 2/1999 | Goto |
| D416,588 | S | 11/1999 | Goto |

(Continued)

FOREIGN PATENT DOCUMENTS

| | | | |
|---|---|---|---|
| CN | 102958572 | A | 3/2013 |
| EP | 1783707 | A1 | 5/2007 |
| WO | WO2016187138 | A1 | 11/2016 |

*Primary Examiner* — David L Lewis
*Assistant Examiner* — Shuana-Kay Hall
(74) *Attorney, Agent, or Firm* — DLA Piper LLP (US)

(57) ABSTRACT

An electronic gaming machine may include an attract mode for promoting use of the electronic gaming machine. The attract mode may include a promotional feature having one or more interactive aspects. Players may interact with the promotional feature to earn a monetary and/or non-monetary promotional award. Promotional awards may be used to modify game play of the games provided by the electronic gaming machine. Promotional awards may also be used to supplement or modify wagers placed on game events.

20 Claims, 5 Drawing Sheets

(56) References Cited

U.S. PATENT DOCUMENTS

D417,211 S 11/1999 Kaneko et al.
D417,664 S 12/1999 Goto
D423,595 S 4/2000 Goto
D430,222 S 8/2000 Goto
D430,223 S 8/2000 Goto
D431,051 S 9/2000 Goto
D432,179 S 10/2000 Hayes
D432,180 S 10/2000 Hayes
D433,076 S 10/2000 Hayes
D434,769 S 12/2000 Goto
D434,770 S 12/2000 Goto
D435,551 S 12/2000 Hayes
6,159,095 A 12/2000 Frohm et al.
6,165,070 A 12/2000 Nolte et al.
D438,543 S 3/2001 Goto
D439,580 S 3/2001 Goto
D441,369 S 5/2001 Goto
D441,759 S 5/2001 Goto
D442,180 S 5/2001 Goto
D442,601 S 5/2001 Goto
D442,967 S 5/2001 Goto
D443,617 S 6/2001 Goto
D443,618 S 6/2001 Goto
D443,877 S 6/2001 Goto
D444,469 S 7/2001 Goto
D444,470 S 7/2001 Goto
D444,790 S 7/2001 Goto
D446,217 S 8/2001 Goto
D447,486 S 9/2001 Goto
D452,867 S 1/2002 Goto
D465,785 S 11/2002 Goto
D469,767 S 2/2003 Hussaini et al.
6,524,184 B1 2/2003 Lind et al.
D481,734 S 11/2003 Goto
6,761,632 B2 7/2004 Bansemer et al.
6,935,946 B2 8/2005 Yoseloff et al.
6,988,732 B2 1/2006 Vancura
D521,015 S 5/2006 Hayes et al.
D522,011 S 5/2006 Hayes et al.
D522,012 S 5/2006 Hayes et al.
D545,317 S 6/2007 Wang et al.
D547,763 S 7/2007 Hayes et al.
D558,651 S 1/2008 Ikeda et al.
7,326,115 B2 2/2008 Baerlocher
D563,480 S 3/2008 Baseflug et al.
D565,668 S 4/2008 Baseflug et al.
D566,781 S 4/2008 Ikeda et al.
D566,782 S 4/2008 Ikeda et al.
D568,409 S 5/2008 Ikeda et al.
D571,367 S 6/2008 Goto et al.
D571,806 S 6/2008 Goto et al.
D572,254 S 7/2008 Goto et al.
D581,422 S 11/2008 Hayes et al.
D594,065 S 6/2009 Oikawa et al.
D594,066 S 6/2009 Oikawa et al.
D594,067 S 6/2009 Oikawa et al.
D602,097 S 10/2009 Oikawa et al.
D607,515 S 1/2010 Oikawa et al.
7,762,553 B2 7/2010 Harris
D620,939 S 8/2010 Suetake et al.
D630,211 S 1/2011 Goto et al.
D630,212 S 1/2011 Goto et al.
D631,049 S 1/2011 Goto et al.
7,874,919 B2 1/2011 Paulsen et al.
7,922,575 B2 1/2011 Jankowski
7,927,204 B2 4/2011 DeBrabander, Jr. et al.
D637,153 S 5/2011 Ikeda et al.
D638,016 S 5/2011 Ikeda et al.
7,950,993 B2 5/2011 Oberberger
7,963,845 B2 6/2011 Baerlocher
D646,275 S 10/2011 Ikeda et al.
D654,120 S 2/2012 Lin
D655,760 S 3/2012 Ikeda et al.
D656,556 S 3/2012 Ikeda et al.
D656,557 S 3/2012 Ikeda et al.
D656,996 S 4/2012 Mikhailov et al.
D657,823 S 4/2012 Gutowski
D658,178 S 4/2012 Ikeda et al.
D658,179 S 4/2012 Ikeda et al.
8,162,742 B2 4/2012 Oberberger
D658,719 S 5/2012 Ikeda et al.
D659,140 S 5/2012 Ikeda et al.
8,192,270 B2 6/2012 Slomiany et al.
8,337,309 B2 6/2012 Okuniewicz
D665,461 S 8/2012 Ikeda et al.
8,317,588 B2 11/2012 Kroeckel et al.
8,337,300 B2 12/2012 Bowers et al.
8,357,034 B2 * 1/2013 Smith ..... G07F 17/32 463/25
8,401,981 B1 * 3/2013 Sandler ..... G06F 1/3231 706/12
8,485,877 B2 7/2013 Saks
8,491,376 B1 7/2013 Di Carlo
8,628,408 B2 1/2014 Popovich et al.
8,651,943 B2 2/2014 Okada
8,715,085 B2 5/2014 Crowder, Jr. et al.
8,734,230 B2 5/2014 Yoseloff
8,753,193 B2 6/2014 Popovich et al.
D709,498 S 7/2014 Morris et al.
D709,499 S 7/2014 Morris et al.
D709,882 S 7/2014 Morris et al.
D714,872 S 10/2014 Chung et al.
D715,296 S 10/2014 Huang
D715,865 S 10/2014 Morris et al.
8,858,321 B2 10/2014 Popovich et al.
8,968,079 B2 3/2015 Kennedy
8,986,105 B2 3/2015 Okuniewicz
8,998,707 B2 4/2015 Arnone et al.
9,251,701 B2 2/2016 Plagge et al.
9,336,656 B2 5/2016 Arnone
D767,682 S 9/2016 Bellinghausen et al.
D768,786 S 10/2016 Seflic et al.
9,530,282 B2 12/2016 Goldman et al.
9,547,956 B1 1/2017 Polyakov et al.
D781,784 S 3/2017 Dingle
D784,986 S 4/2017 Kujawski et al.
D794,717 S 8/2017 Kujawski et al.
D805,518 S 12/2017 Goldman et al.
D806,078 S 12/2017 Goldman et al.
9,865,138 B2 1/2018 Goldman et al.
10,140,813 B2 11/2018 Arnone et al.
2003/0137109 A1 7/2003 Vancura
2003/0171144 A1 9/2003 Letovsky
2003/0199305 A1 10/2003 Mathis
2006/0148560 A1 * 7/2006 Arezina ..... G07F 17/3255 463/29
2006/0160624 A1 * 7/2006 Slomiany ..... G07F 17/3267 463/42
2006/0189377 A1 8/2006 Gomez et al.
2006/0281528 A1 12/2006 Hall et al.
2007/0298874 A1 12/2007 Baerlocher et al.
2007/0298875 A1 12/2007 Baerlocher et al.
2008/0076515 A1 3/2008 Baerlocher et al.
2008/0081689 A1 4/2008 Seelig et al.
2009/0061991 A1 3/2009 Popovich et al.
2009/0061997 A1 3/2009 Popovich et al.
2009/0061998 A1 3/2009 Popovich et al.
2009/0061999 A1 3/2009 Popovich et al.
2009/0239662 A1 9/2009 Bramble
2009/0270163 A1 10/2009 Mitelman
2009/0280891 A1 11/2009 Filipour et al.
2010/0022291 A1 * 1/2010 Segreto ..... G07F 17/3248 463/19
2010/0160030 A1 6/2010 Indrakumar
2011/0009178 A1 1/2011 Gerson
2011/0118011 A1 5/2011 Filipour et al.
2011/0212766 A1 9/2011 Bowers et al.
2011/0218035 A1 9/2011 Thomas
2013/0012291 A1 * 1/2013 Dorr ..... G07F 17/3244 463/20
2013/0012301 A1 * 1/2013 Dorr ..... G07F 17/3255 463/25
2013/0131848 A1 5/2013 Arnone et al.
2013/0237326 A1 9/2013 Arnone et al.

(56) References Cited

U.S. PATENT DOCUMENTS

| | | | | |
|---|---|---|---|---|
| 2013/0244751 | A1* | 9/2013 | Bennett | G07F 17/34 463/20 |
| 2013/0252718 | A1 | 9/2013 | Arnone et al. | |
| 2013/0281171 | A1 | 10/2013 | Ramsour et al. | |
| 2013/0291194 | A1* | 10/2013 | Bergemann | C11B 1/00 800/275 |
| 2014/0073405 | A1 | 3/2014 | Arnone et al. | |
| 2014/0087808 | A1 | 3/2014 | Basallo et al. | |
| 2014/0141863 | A1 | 5/2014 | Arnone et al. | |
| 2014/0228083 | A1 | 8/2014 | Arnone et al. | |
| 2014/0378219 | A1 | 12/2014 | Arnone et al. | |
| 2015/0080074 | A1 | 3/2015 | Arnone et al. | |
| 2015/0111632 | A1 | 4/2015 | Meyer | |
| 2016/0117890 | A1 | 4/2016 | Arnone et al. | |
| 2016/0343211 | A1 | 11/2016 | Goldman et al. | |
| 2017/0092068 | A1 | 3/2017 | Vann | |
| 2017/0148271 | A1 | 5/2017 | Goldman et al. | |
| 2017/0278352 | A1* | 9/2017 | Cuddy | G07F 17/3218 |
| 2017/0337776 | A1 | 11/2017 | Herring et al. | |
| 2018/0047253 | A1 | 2/2018 | Vann | |
| 2018/0082515 | A1 | 3/2018 | de Mello Costa | |
| 2018/0082530 | A1 | 3/2018 | Upton et al. | |
| 2018/0082533 | A1 | 3/2018 | Hallerbach et al. | |
| 2020/0005594 | A1 | 1/2020 | Santisi | |
| 2020/0168035 | A1* | 5/2020 | Lancaster | G07F 17/3239 |

* cited by examiner

GAMING SYSTEM HAVING AN INTERACTIVE ATTRACT MODE FOR PROMOTING GAME USE

RELATED APPLICATIONS/PRIORITY CLAIMS

This application claims the benefit under 35 USC 119(e) and 120 of U.S. Provisional Application No. 62/797,220 filed Jan. 26, 2019, and which is incorporated herein by reference.

FIELD

The disclosure relates generally to systems and methods of providing, hosting, conducting, and/or facilitating wagering games including game play features that may be offered to facilitate and encourage game play thereon.

BACKGROUND

Many games have been developed over the years and some are particularly adapted for wagering. The popularity of such games may depend on the likelihood (or perceived likelihood) of winning the game and the amount of entertainment enjoyed while playing the game relative to other available gaming options. Many players have grown accustom to playing electronic games in establishments having a wide range of available gaming options with roughly the same (or believed to be the same) expectation of winning. Therefore, players may choose to play the games that deliver the most entertaining, exciting, and/or appealing gameplay experience. To attract users, wagering game operators may choose to operate a wide variety of gaming machines that facilitate games that are entertaining and exciting to play. Machines facilitating more entertaining games may be more attractive to play and more frequently played thereby increasing the profitability to the operator.

There is a need to provide additional types of games having entertaining and attractive promotional game play features. Players seek more entertaining gameplay experiences and wagering game operators wish to attract more frequent play of wagering games. Accordingly, there is continual interest and need for such wagering games.

DETAILED DESCRIPTION OF ONE OR MORE EMBODIMENTS

Figure 1:
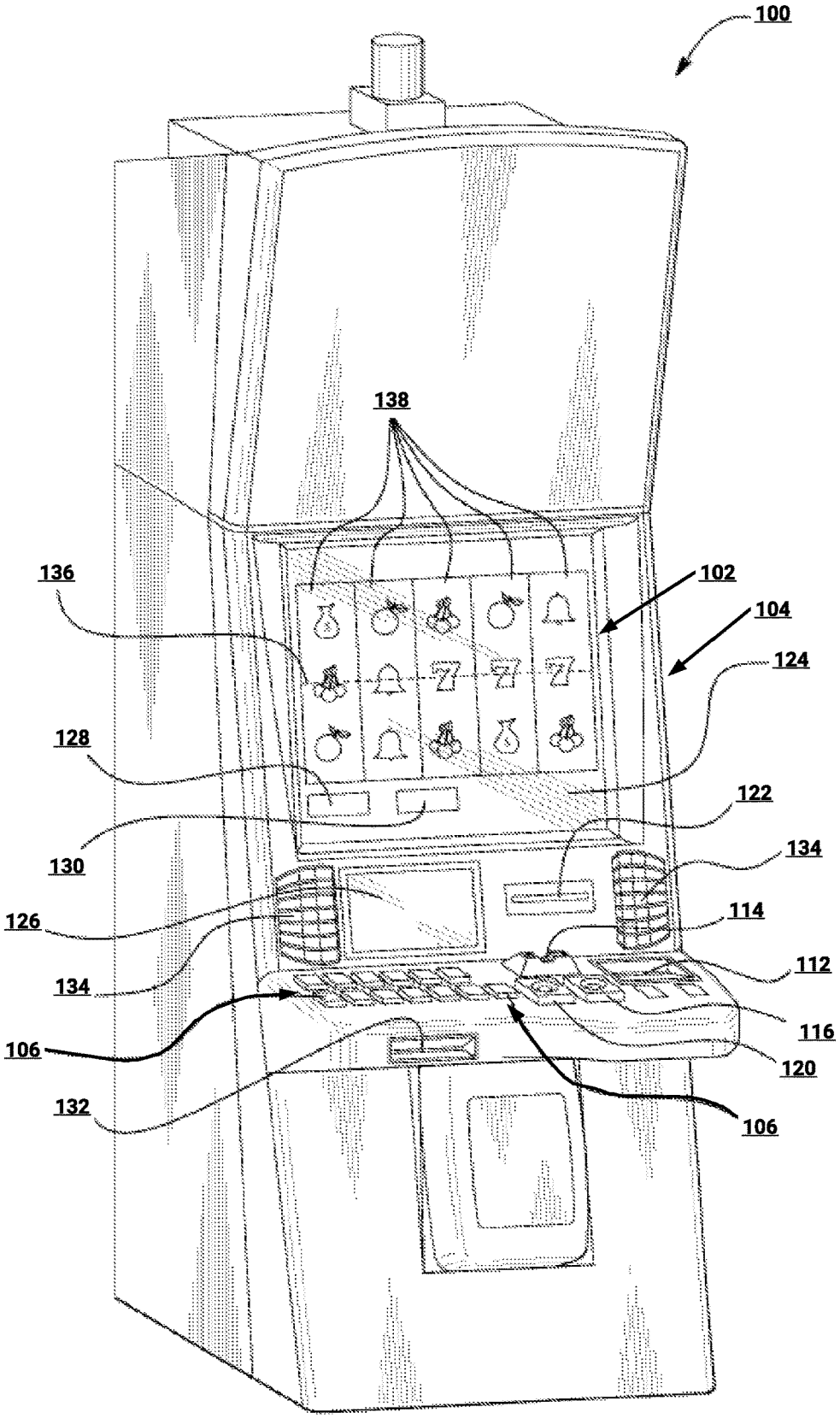
FIG. 1 illustrates an example of an electronic gaming machine 100 that may include a wagering game having game play features generating in game award pools.

FIG. 1 illustrates an example of an electronic gaming machine 100 that may include a wagering game 102. The wagering game 102 may include game of chance aspects and game of skill aspects. Although a slot machine style gaming machine is shown in FIG. 1, the wagering game 102 may be implemented on other known and yet to be developed computerized gaming systems and may be implemented on a single player electronic gaming machine and/or multi-player electronic gaming machine. For example, the wagering game 102 disclosed herein may be implemented on a personal computer system, a laptop computer, a tablet computer, a smartphone device or a personal gaming system.

Each electronic gaming system 100 may have a display 104 on which the user interface aspects of the wagering game 102 may be displayed. In some embodiments, the display 104 may be a touchscreen that displays the user interface of the wagering game and allows the user to interact with the wagering game in a known manner. The display 104 may include one or more display aspects, for example, a central display 124, player tracking display 126, a credit display 128, a bet display 130, and the like. The display 104 of the electronic gaming machine 100 may be configured to display any suitable visual representation or exhibition of the movement of objects; dynamic lighting; video images; images of people, characters, places, things, and faces of cards; and the like. In certain embodiments, the display 104 of the electronic gaming machine 100 is configured to display one or more video reels, one or more video wheels, and/or one or more video dice. In other embodiments, certain of the displayed images, symbols, and indicia are in mechanical form. In these embodiments, the display 104 may include any electromechanical device, such as one or more rotatable wheels, one or more reels, and/or one or more dice, configured to display at least one of a plurality of games or other suitable images, symbols, or indicia.

The electronic game machine 100 may also have one or more input devices 106. Players may use the input devices 106 to interact with the electronic game machine. Input devices may include various depressible buttons and/or touch sensors. One or more of the input devices of the electronic gaming machine may also be a cash out device. The cash out device is utilized to receive a cash payment or any other suitable form of payment corresponding to a quantity of remaining credits of a credit display 128. The electronic gaming machine 100 may include a cash out device in the form of a cash out button 120. The electronic gaming machine 100 may also include one or more game play activation devices that are each used to initiate a play instance of a game on the electronic gaming machine 100. The game play activation device may include a game play initiation button 116. In various embodiments, the electronic gaming machine 100 may begin game play automatically upon appropriate funding rather than upon utilization of the game play initiation button 116 or other game play activation device.

In various embodiments, input devices 106 may include the touch-screen display coupled to a touch-screen controller or other touch-sensitive display to enable interaction with any images displayed on a display 104. One touch screen input device may be a conventional touch-screen button panel. The touch-screen and the touch-screen controller may be connected to a video controller. In touchscreen embodiments, players input signals in the electronic gaming machine 100 by touching the touch screen at the appropriate locations.

In various embodiments, other input devices 106 may be included in a player tracking system. Player tracking systems enable operators of the gaming systems (such as casinos or other gaming establishments) to recognize the value of customer loyalty by identifying frequent customers and rewarding them for their patronage. Player tracking systems may be configured to track a player's gaming activity. The player tracking system may track a player's gaming activity using a player tracking card, for example a player identification card. The player identification card may have an encoded player identification number that uniquely identifies the player. To facilitate player tracking, the player tracking system may include a card reader 122 input device. The card reader 122 may be configured to read a player identification card inserted into the card reader. When the player's player identification card is inserted into a card reader 122, the card reader 122 reads the player identification number off the player identification card to identify the player. The gaming system then tracks the identified player's gaming session. When the player finishes a gaming session, the player removes their player identification card from the card reader 122. By tracking when the player identification card is removed, the gaming system may determine when the player concludes the gaming session. The gaming system may also track players without using a player identification card. For example, the gaming system may use one or more portable devices, such as a mobile phone, a radio frequency identification tag, or any other suitable wireless device, to track when a gaming session begins and ends. The gaming system may also use any biometric technology or ticket technology to identify a player and/or track when a player's gaming session begins and ends.

During one or more gaming sessions, the player tracking system may track aspects of the gaming session, for example any amounts wagered, average wager amounts, and/or the time at which these wagers are placed. The player tracking system may also generate and track other player data including the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, and the like. Tracked player data and/or any suitable feature associated with the player tracking system may be displayed on a player tracking display. In various embodiments, the player tracking display may be included in a display 104 of the electronic gaming machine.

The electronic gaming machine 100 may provide a wagering game 102. The electronic gaming machine 100 may provide a variety of wagering games 102 with each game having one or more of a plurality of different features, attributes, or characteristics. For example, the electronic gaming machine 100 can provide a wagering game 102 that includes a payline 136 and a plurality of reels 138 as part of a conventional slot-type primary game involving spinning reels with each reel displaying a plurality of indicia or symbols. The gaming machine may also provide a wagering game 102 that includes skill-based games. The operation of the wagering game 102 may be impacted to achieve a desired return to player ("RTP"). In various embodiments, the wagering game 102 may include one or more game events. The game events may have a game of chance aspect and/or game of skill features as described below wherein the payout to the player from the wagering game depends on the results of at least one of the game of chance aspects and the skill-based game features. To enhance the game play of the wagering game, the electronic gaming machine 100 may also include a sound generating device including one or more speakers 134 or other sound generating hardware and/or software for generating sounds. The sound generating device may be used to play music for wagering games and/or play music for other modes of the electronic gaming device 100, such as an attract mode.

The electronic game machine 100 may also include payment devices to facilitate exchanging payment for credits used to place wagers. The payment devices may include, for example, a combined bill and ticket acceptor 112, and a player loyalty card receiving slot 114. To facilitate settlement of payouts during and/or after an instance of play of the wagering game 102, the electronic gaming machine 100 may include a payout device. The payout device may cause a payout to be provided to the player in response to a player input, for example, pressing a cash out button 120. The payout device may be one or more of: a ticket generator 132 configured to generate and provide a ticket or credit slip representing a payout that may be redeemed via a cashier, a kiosk, or other suitable redemption system; a note generator configured to provide paper currency; a coin generator configured to provide coins or tokens in a coin payout tray; and any suitable combination thereof. The electronic gaming machine 100 may include, for example, a ticket generator 132. The electronic gaming machine 100 may also include a payout device configured to fund an account associated with electronically recordable player identification card or smart card and/or a bank account via an electronic funds transfer.

Figure 2:
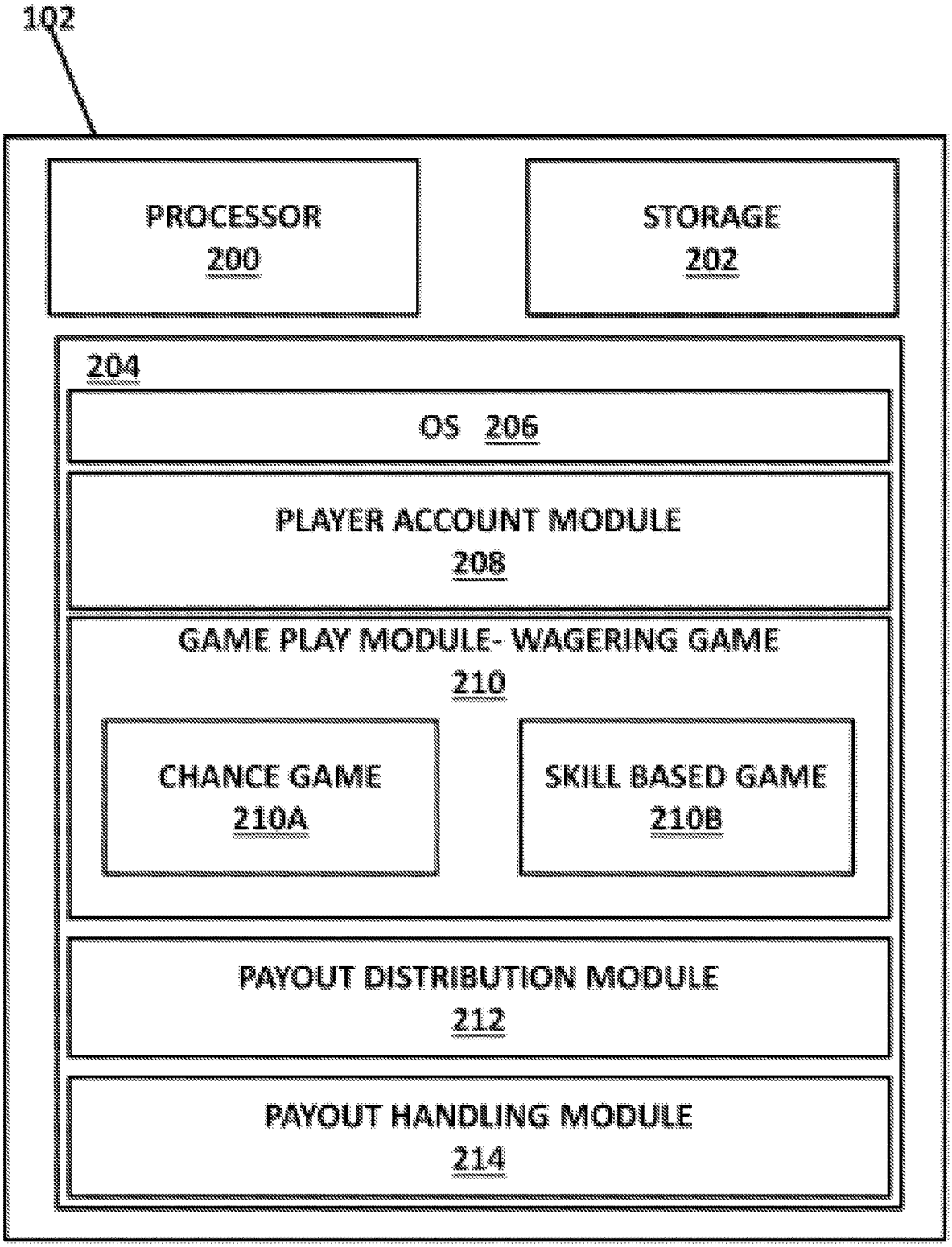
FIG. 2 illustrates more details of the wagering game 102 of the electronic gaming machine shown in FIG. 1.

FIG. 2 illustrates more details of the wagering game 102 of the electronic gaming machine shown in FIG. 1. The wagering game 102 may be implemented on an electronic gaming system that may have one or more processors 200, a storage 202, and a memory 204 that are all interconnected to each other. The processors 200, storage 202, and memory 204 are managed by an operating system 206 executed by the processor 200 and stored in the memory 204. In one embodiment, the wagering game 102 may be a plurality of instructions/computer instructions/code that stored in the memory 204 or storage device 202 and executed by the one or more processors 200 to implement the game of chance aspects and skill-based game aspects of each game event in the wagering game 102. In one embodiment, the wagering game 102 may be one or more modules as shown in FIG. 2 in which each module is a plurality of lines of instructions and each module may communicate and interact with the other modules and perform a particular collection of one or more processes that are part of the wagering game 102.

In one embodiment, the wagering game 102 may further include a player account module 208, game play module 210, a payout distribution module 212 and a payout handling module 214 as shown in FIG. 2. The player account module 208 handles the receiving of input needed to establish credit associated with a player for use in the play of the wagering game 102 on the computerized platform. The game play module 210 may implement the wagering game play that includes one or more game events having a chance game portion 210A and/or a skill-based game portion 210B. The one or more game events included in the wagering game 102 may incorporate change game aspects and skill-based game aspects. The game play module 210 may control aspects relating to play of instances of the wagering game 102, which in this embodiment, involves a game event including the provision of an interactive skill-based game for play on the computerized platform responsive to receiving a wager debited to the credits established in the player account by the player account module 208.

The game play module 210 may also modify game play of the wagering game 102 to facilitate a more entertaining experience for the player. The game play module 210 may provide non-monetary awards in the form or one or more tokens or other units to a player account during game play. The non-redeemable tokens may be applied during further game play to enhance game play, provide additional features, confer benefits and/or result in achieving the desired return to player (RTP) of the gaming system. The game play module 210 may also provide one or more secondary game events to provide players an additional opportunity to earn monetary and/or monetary awards during an instance of play of the wagering game. In various embodiments, a player may apply the non-redeemable tokens to cause the game play module 210 to generate a secondary game event. The game play module 210 may also generate a secondary game event based on one or more game play aspects of the wagering game. The game play module 210 may also provide one or more promotional features included in an attract mode of the electronic gaming device.

The payout distribution module 212 determines the frequency and amount or value of a payout or prize associated with a game event included in an instance of play of the wagering game. For example, the payout distribution module 212 may determine a potential award for a game event, gameplay conditions to satisfy in order to earn the potential award, and if one or more of the gameplay conditions are satisfied during the game event. The payout handling module ("payout handler") 214 determines features from a group of preset features relating to the communication of the payout or prize to a player, such as through the display of information relating to the payout or prize during an instance of play of the game that may be displayed, for example on the display 104 of the electronic gaming machine 100 or computerized platform. In one embodiment, using the electronic gaming machine 100 shown in FIGS. 1-2 may be used to implement a method of providing a wagering game through executable instructions which upon execution by a processing device 200 provides for hosting, conducting, and/or facilitating modified wagering games which include game events having outcomes dependent at least in part on chance (that is, a "chance-based game" or "chance game" as used herein) and which involve game play of a skill-based game, that is, a game having an outcome which is at least in part, if not predominantly, dependent on the demonstration of skill by a player, such as twitch-skill and/or the strategic use of time (a "skill-based game" or "skill game" as used herein).

Figure 3:
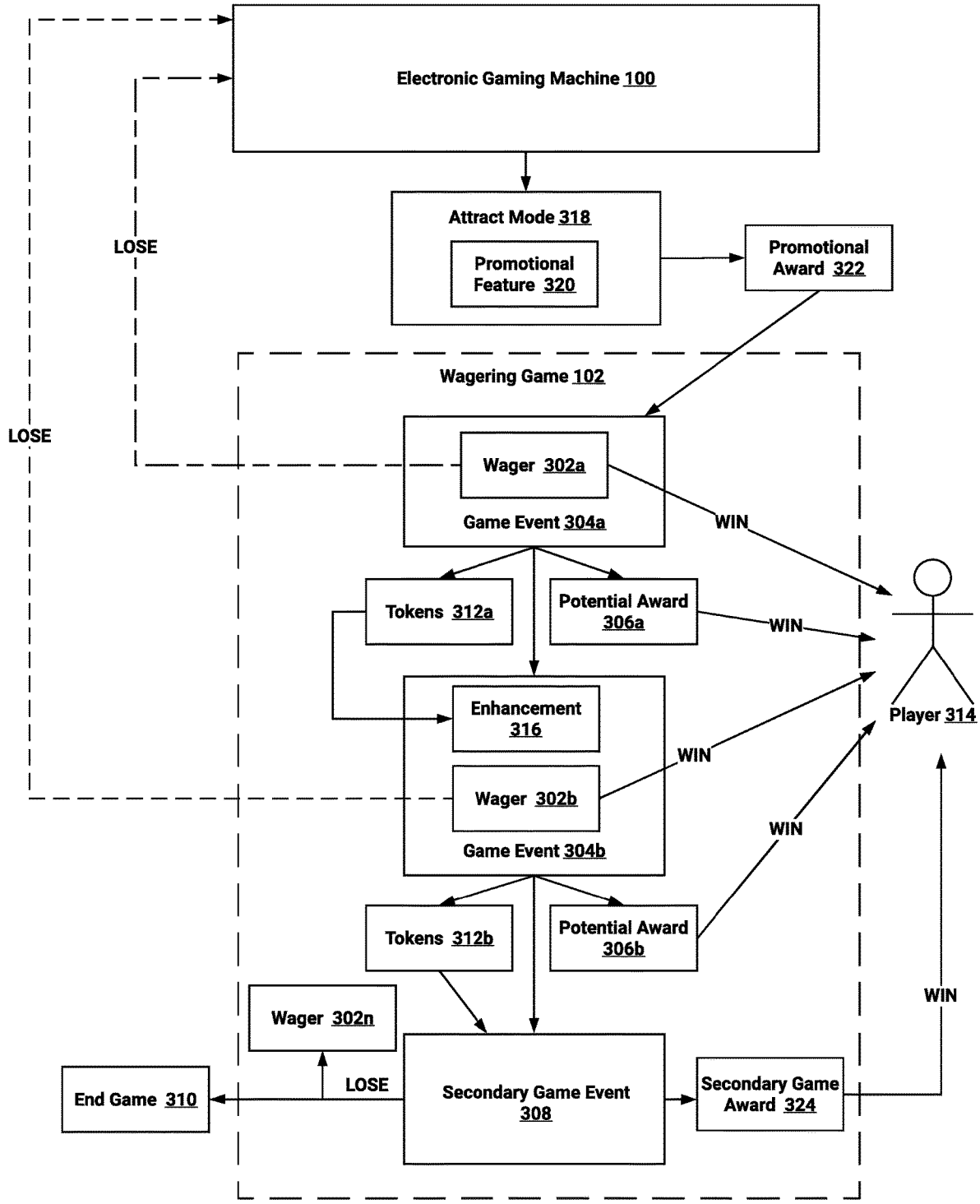
FIG. 3 illustrates an exemplary gameplay sequence included in a wagering game 102 provided by the electronic gaming machine.

FIG. 3 illustrates an exemplary game play on an electronic gaming machine. As shown in FIG. 3, the electronic gaming machine 100 may provide an attract mode 318 for promoting play of one or more games on the electronic gaming machine 100. The attract mode 318 may include one or more promotional features 320, such as a playable demo and/or an interactive tutorial. Upon completion of the promotional feature 320, the electronic gaming machine 100 may distribute one or more promotional awards 322 to the player. Promotional awards 322 may be monetary and/or non-monetary awards. Exemplary monetary promotional awards 322 may include credits and/or free credits that a player may use to place a wager 302*a-b* on a game event 304*a-b*. Promotional awards 322 may also include non-monetary awards such as tokens 312*a-b* that may be redeemed during a game event 304*a-b* to obtain an advantage and/or benefit in the game event 304*a-b*.

The electronic gaming machine 100 may provide a wagering game 102 including one or more game events 304*a-b*. The game events 304*a-b* may be automatically initiated in response to a player 314 placing a wager 302*a-n*. Game events 304*a-b* may include game play activities within the wagering game. Game events 304*a-b* may be activities within the normal gameplay of the wagering game 102. For example, game events 304*a-b* may include the same activities as other game play of the wagering game 102, such as shooting a basketball in a basketball simulation wagering game, shooting a dart in a darts throwing wagering game, playing a hand of cards in a poker wagering game, and the like. Game events 304*a-b* may also include discrete activities that are separate from other game play of the wagering game. For example, game events 304*a-b* may include a bonus basketball shot within a 2 on 2 or 5 on 5 e-sports basketball simulation game. Other game events may include a bonus hand of poker against, for example, only the dealer, within a poker game against a number of other players.

The wager 302*a-n* may be the same as the wager placed at the outset of an instance of play of a wagering game 102. The wager 302*a-n* may also be a separate wager placed during game play of the wagering game on the outcome of a game event 304*a-b*. Payout and/or loss of the wager 302*a-n* may be completely settled following the outcome of the game event 304*a-b*. Therefore, the game events 304*a-b* allow players 314 to place wagers 302*a-n* on individual game play activities within the wagering game 102. For example, the wagering game 102 may provide a game event 304*a-b* that allows the player 314 to wager on an individual shot within a basketball simulation game, a single round of darts within a darts game, an individual hand of poker within a poker game, a single card within a blackjack game, and the like.

After the electronic gaming machine 100 receives the wager 302*a-n* and initiates the game event, the wagering game 102 may determine a potential award 306*a-c* for each game event. The potential award 306*a-c* may be an additional award the player 314 can win that is separate from the wager 302*a-n*. The wagering game 102 may also determine whether to award tokens 312*a-b* for the game event. Tokens 312*a-b* may be a non-monetary award that is not redeemable for cash. The potential award 306*a-c* and/or tokens 312*a-b* may be generated for a game event 304*a-b* based on one or more aspects of game play that occurred during the instance of play of the wagering game 102. The player 314 may be made aware of the conditions required to generate a potential award 306*a-c* and tokens 312*a-b* for a game event 304*a-b*. For example, the conditions required to generate a potential award 306*a-c* and/or tokens 312*a-b* for a game event 304*a-b* may be displayed as a graphic or animation on a display of the electronic gaming machine. The conditions triggering generation of a potential award 306*a-c* and/or tokens 312*a-b* may also be unknown to the player 314.

The conditions for winning the potential award 306*a-c* and/or receiving the tokens 312*a-b* may be the same or different from the conditions for winning the wager 302*a-n*. For example, players may win a wager 302*a-n* by achieving a successful outcome of a game event 304*a-b*, for example, shooting a ball through a hoop in a basketball simulation game. Achieving the successful outcome may also be the criterion for winning a potential award 306*a-c* and/or receiving tokens 312*a-b*. The criterion for winning a potential award 306*a-c* and/or receiving tokens 312*a-b* may also be different from achieving a successful outcome of the game event 304*a-b*. For example, the criterion for winning a potential award 306*a-c* and/or receiving tokens 312*a-b* may be attempting a basketball shot from beyond a certain distance away from the hoop, shooting a basketball shot within a preset time period, missing the hoop within a particular threshold defining a near miss, and the like. In various embodiments, winning a wager may depend on achieving more than one outcome in a game event 304*a-b*.

Winning a potential award 306*a-c* and/or receiving tokens 312*a-b* may also depend on satisfying more than one criteria of a game event 304*a-b*.

After the game event is initiated and the potential award set, a player 314 performs the game play for the game event 304*a-b*. The player 314 may perform the game play by entering inputs into the electronic gaming machine, for example, by pressing buttons. The electronic gaming machine 100 receives the inputs and interprets the inputs as an outcome of the game event 304*a-b*. If the electronic gaming machine 100 determines the player 314 has achieved a successful outcome, then the player may win the one or more of the wagers 302*a-n* as shown in FIG. 3. If the electronic gaming machine 100 determines the player has not achieved a successful outcome, the wagers 302*a-n* may be lost and kept by the electronic gaming machine as shown in FIG. 3. To determine if the player 314 receives the potential award 306*a-c* and/or tokens 312*a-b*, the game event outcome may be compared to a criteria for winning the potential award 306*a-c* and/or receiving the tokens 312*a-b*. If the criteria for winning the potential award 306*a-c* is satisfied by the player 314 during the game event 304*a-b*, the potential award 306*a-c* is distributed to the player 314. If the criteria for receiving the tokens 312*a-b* is satisfied by the player 314 during the game event 304*a-b*, the tokens 312*a-b* are distributed to the player. If the criteria for winning the potential award 306*a-c* is not satisfied by the player 314 during the game event 304*a-b*, the potential award 306*a-c* is not distributed to the player 314 and may be added to an award pool. If the criteria for receiving the tokens 312*a-b* is not satisfied by the player during the game event 304*a-b*, the tokens 312*a-b* are not be distributed to the player 314.

Tokens may be used to modify the game play of a game event 304*a-b*. For example, tokens may be used to generate one or more game play enhancements 316. The enhancements 316 may provide the player 314 an advantage or benefit in the game, such as a faster car in a racing game or a bigger hoop in a basketball shot game. The enhancements 316 may also improve the chances of achieving a successful outcome in a game event 304*a-b* by, for example, lowering the level of skill required to achieve a successful outcome in a skill-based game event. Enhancements 316 may also make the game play of the game event 304*a-b* more entertaining for the user. For example, a player may use tokens 312*a-b* to play a particular song or sound effect during game play of the game event 304*a-b*. The player may also use tokens 312*a-b* to unlock a different level or modify the appearance of one or more aspects (e.g., characters, setting, objects, and the like) of the game event 304*a-b*.

After one or more game events 304*a-b* is completed, a secondary game event 308 may be initiated. Secondary game events may include a bonus game event, and award pool game event, or other game event outside of the primary game events 304*a-b* included in the wagering game 102. During game play of a wagering game 102, tokens 312*a-b* may also be used to initiate a one or more secondary game events 308, for example a bonus game event. Secondary game events 308 may also be initiated by one or more aspects of game play. For example, a secondary game events 308 may be initiated in response to a certain number of player wins, a certain number of player losses, the instance of play of a wagering game extending beyond a period of time, a number of game events played, the number of tokens 312*a-b* stored in a player account, the amount of potential awards 306*a-b* included in an awards pool, and the like. Secondary game events 308 may provide players 314 an opportunity to win monetary and non-monetary awards. Secondary game events 308 may be activities that are included in and/or separate from other game play of the wagering game 102, such as a wheel spin. Secondary game events 308 may require the player to make a wager 302*a-b* or may be initiated without a player 314 making a wager 302*a-b*. The conditions for initiating a secondary game event 308 may be known or unknown to the player 314.

To win a secondary game event 308, a player 314 must satisfy one or more criteria of the secondary game event 308. If the one or more criteria are satisfied, the player 314 may win a secondary game award 324, for example, a jackpot award or other bonus award, a potential award from an awards pool, and the like. The jackpot award may include all or a portion of a progressive jackpot aggregated during one or more instances of play of the wagering game 102 on one more electronic gaming machines 100. A player may also win a secondary game award 324 if a particular outcome of a secondary game event 308 is achieved, such as landing on a particular segment of a wheel. If the one or more criteria for winning a secondary game event 308 are not satisfied and/or a winning outcome does not occur, the secondary game award 324 is not distributed to the player 314. After losing a secondary game event 308, players 314 may begin a new game event 304*a-b* by placing a wager 302*n* or end the instance of play of the wagering game 310.

The wagering game 102 gameplay shown in FIG. 3 may be an example of a continuous game play. In the continuous game play, a player 314 places a first wager 302*a*. In response to receiving the first wager 302*a*, the wagering game 102 initiates a first game event 304*a* and generates a first potential award 306*a* and first tokens 312*a* for the first game event 304*a*. The player 314 performs the game play for the first game event 304*a* and the first wager 302*a* and first potential award 306*a* are settled based on the outcome of the first game event 304*a*. Upon settlement of the first game event 304*a*, the wagering game 102 may automatically require a second wager 302*b*. In response to receiving the second wager 302*b*, the wagering game 102 may initiate a second game event 304*b* and generate a second potential award 306*b* and second tokens 312*b* for the second game event 304*b*. The player 314 performs game play for the second game event 304*b* and the second wager 302*b* and the second potential award 306*b* are settled based on the outcome of the second game event 304*b*.

Upon settlement of the second game event 304*b*, the wagering game 102 may initiate a secondary game event 308. The player 314 performs game play for the secondary game event 308 and the secondary game award or other award for the secondary game event 308 is settled based on the outcome of the secondary game event 308. Upon settlement of the secondary game event 308, the player 314 may place another wager 302*n* to continue the continuous game play and initiate one or more subsequent game events and/or secondary game events. The player 314 may also end the game 310 by not placing a wager. The continuous game play may continue as long as the player 314 has credits to wager and places a wager after settlement of a game event or secondary game event. The sequence of game events and/or secondary game events may include more than three events and the order of the game events and/or secondary game events in the sequence may be the same or different as the sequence shown in FIG. 3.

Figure 4:
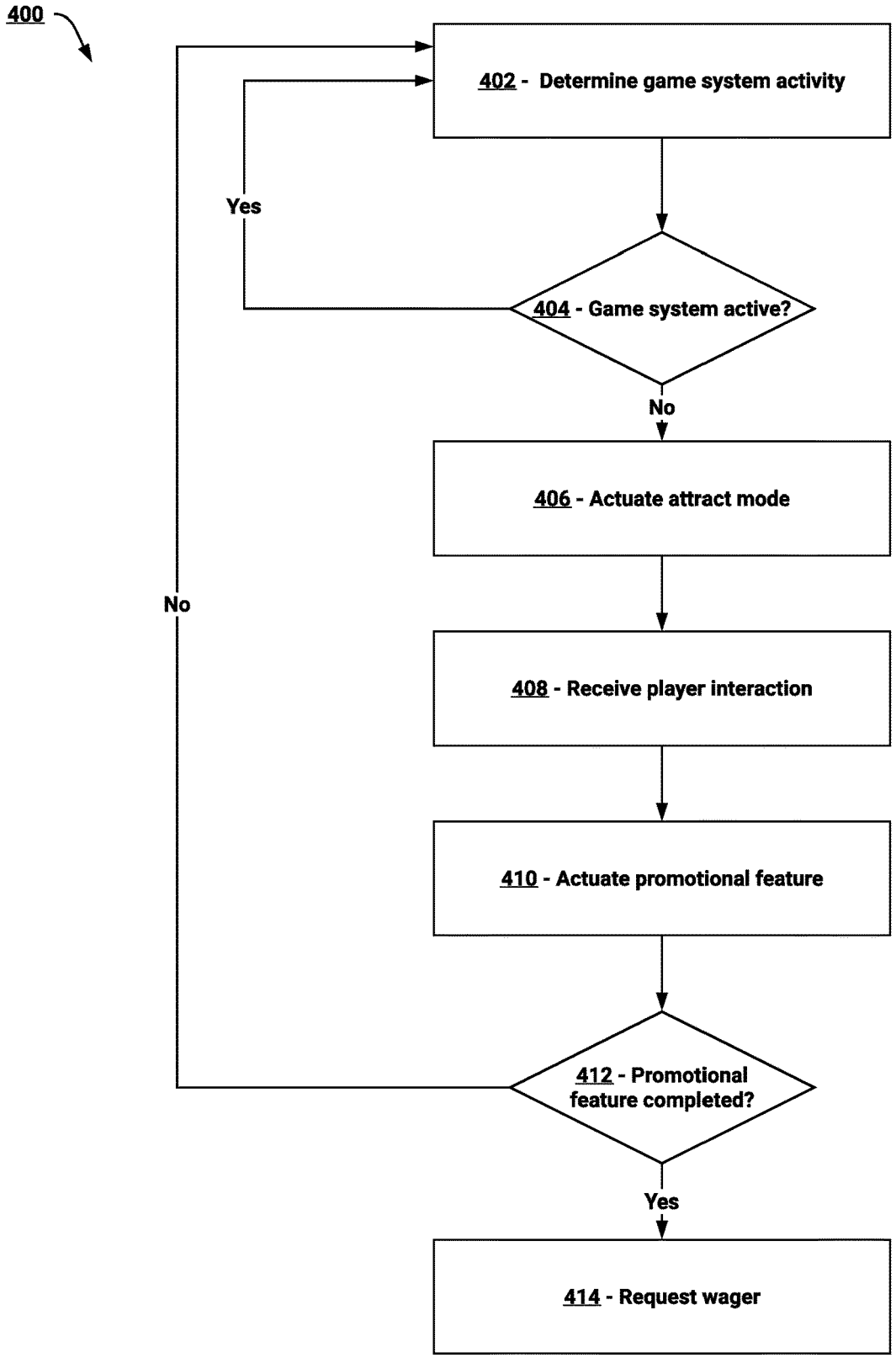
FIG. 4 is a flowchart illustrating a method of providing an attract mode.

FIG. 4 illustrates a flowchart of an exemplary embodiment of a method 400 of operating the gaming system to provide an attract mode. The attract mode may include one or more promotional features for attracting players to play wagering games on the gaming system. Promotional features may include tutorials which explain some or all of the game play aspects of the wagering game to educate and/or inspire the player to start an instance of play of the wagering game. Promotional features may also include a playable demo of one or more game events included in the wagering game. The game play of the playable demo may be the same or different from the game events or secondary game events provided by the gaming system. The promotional feature may also include both a playable game and a tutorial. The promotional feature can be interrupted by adding a credit balance. Adding a credit balance during the promotional feature may change one or more aspects of the promotional feature, for example, the information displayed in a tutorial or the game play of a playable demo. Adding a credit balance may also have no effect on the promotional feature.

At 402, the gaming system determines if the gaming system is active. Activity and/or inactivity of the gaming system may be determined by detecting or not detecting certain data signals within the gaming system. For example, the gaming system may determine the gaming system is not active based on detecting the credit balance meter has fallen to zero. Conversely, the gaming system may determine the gaming system is active is the credit balance meter was previously at zero and is now funded. The gaming system may also determine activity by monitoring user interaction with the gaming system. For example, if the gaming system detects no user interaction with the gaming system for a defined period of time, the gaming system may determine the gaming system is in-active and may initiate a tutorial or other promotional feature.

If the gaming system determines the gaming system is not active at 404, the gaming system initiates attract mode on the gaming system at 406. For example, the gaming system may initiate attract mode on the gaming system by displaying attract mode features on an electronic gaming system. If the gaming system determines the gaming system is not active at 404, the gaming system does not initiate attract mode and continues to monitor the activity of the gaming system by determining if the electronic gaming machine is active at 402.

Once the attract mode is actuated, the gaming system may receive a player interaction at 408. Player interactions may include, for example, one or more player inputs. The player inputs that may actuate the promotional feature may comprise a wager, whether for real money, virtual currency or credits. Other player inputs may also actuate the promotional feature including one or more selections received by an input device of the electronic gaming machine, for example, selections made by pressing buttons on the input device or tapping a particular area of a touch screen. Player interactions, such as identification of a player by the gaming system may also actuate the promotional feature. For example, the promotional feature may be actuated by inserting a loyalty card or other player identification card into an electronic gaming machine. Based on the player interaction, the gaming system may actuate a promotional feature at 410.

A promotional feature may also be made accessible if certain preset promotional feature conditions exist are satisfied. The promotional feature conditions may be the same as the conditions required to be met for the electronic gaming machine's promotional attract mode to be triggered. For example, the promotional feature conditions may include ending a prior game session, no initiation of a new game session, zero remaining credit balance, no new additional credits added to the credit balance, no establishment of a new credit balance, and the like. The preset promotional feature conditions may also include the passage of a preset time period, such as a preset period in which the electronic gaming machine remains idle, a preset period in which the electronic gaming machine remains in attract mode, and the like. The promotional feature may also be actuated in response to the performance of an audio and/or visual display on the electronic gaming machine.

The gaming system may also make a promotional feature available based on detecting one or more promotional feature conditions the indicate a player is new to the game. For example, the gaming system may determine a player is new based on how much and/or how often the player funds the credit balance meter. New players may also be detected based on reading information stored on a player identification card. Once a new player is detected, the gaming system may promote the game through the tutorial or other promotional feature. Tutorials and other promotional features may also be initiated when a player unlocks a new feature of the game. For example, the player unlocks a bonus feature or other separate feature for the first time during an instance of play. When the new features are unlocked, the gaming system may play an interactive tutorial or other promotional feature to explain how the new feature works. Tutorials and other promotional features may also be actuated based on use of tokens or other non-redeemable in-game currency. If a player uses a token to get a benefit or advantage in the game that has not been received before, the gaming system may actuate a tutorial or other promotional feature to explain how to use the new benefit and/or advantage and how the new benefit and/or advantage works. For advantages that are unlocked automatically based on an accumulation of a certain number of tokens, the gaming system may actuate a demo, tutorial or other promotional feature to explain what the advantage and/or bonus is and how to use/play it. The availability of the promotional feature, requisite player interactions, criteria for determining a new player, criteria for determining a first use of a token or feature, and/or promotional features conditions may be displayed on the electronic gaming machine. The notification displayed on the electronic gaming machine may include one or more graphics or animations. The notification may also include an audio and/or video presentation on the electronic gaming machine.

Once the promotional feature is actuated, a player may interact with the promotional feature. In response to receiving one or more player interactions with the promotional features, the gaming system may check if the promotional feature is completed at 412. If the player has successfully completed the promotional feature, for example, completed the tutorial or competed game play of the playable demo, the gaming system may request a wager at 414 to begin the game play of the wagering game. If the player does not complete the promotional feature, for example, stops interacting with the gaming system before the promotional features is completed, the gaming system may determine game system activity at 402 to make sure the system is not inactive. If the system is inactive, the game system may restart the attract mode at 406.

Figure 5:
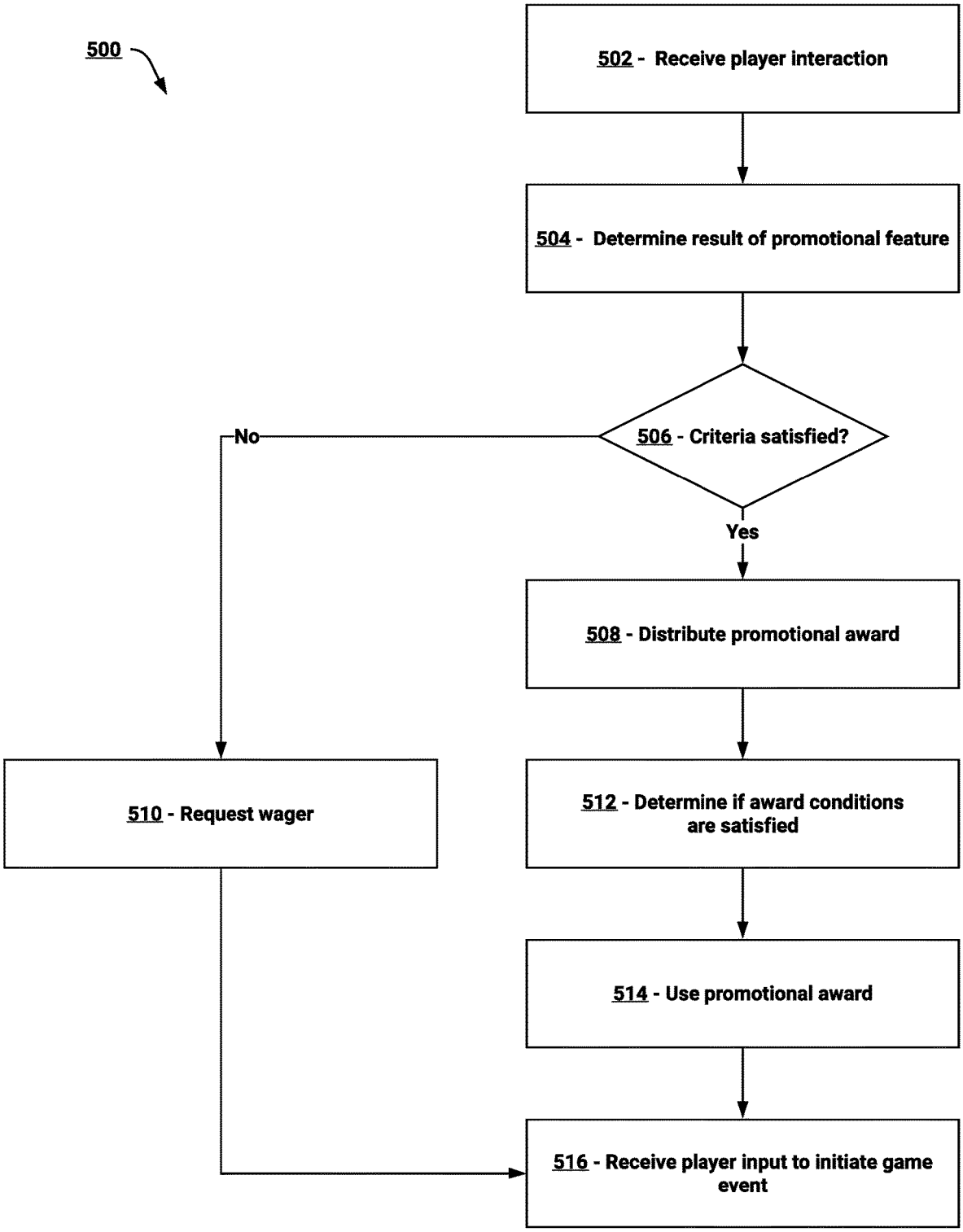
FIG. 5 is a flowchart illustrating a method of distributing a promotional award.

FIG. 5 illustrates a flowchart of an exemplary embodiment of a method 500 of operating the gaming system to distribute a promotional award. At 502, the gaming system may receive player interactions with the promotional award. Players may interact with the promotional feature by, for example, entering one or more player inputs into a input device of the electronic gaming machine. The promotional feature may include, for example, a game play activity or display of an interactive tutorial. The promotional feature may include one or more promotional game events. Players may complete game play of the one or more promotional game events to earn one or more monetary and/or non-monetary awards. The promotional game events included in the promotional feature may be play for fun game events wherein the outcome of the game provides no monetary benefit. Play for fun game events may permit the player to experience game play of one or more game events included in the wagering game without placing anything of value at risk. Promotional game events may also provide players the opportunity to win a promotional award. Promotional awards may be non-monetary awards, for example, tokens that cannot be redeemed for cash and/or monetary awards, for example, credits that may be used to place wagers and can be redeemed for cash. The promotional feature may be operated locally on the electronic gaming machine and/or provided through an external server using the electronic gaming machine as a client device.

At 504, the gaming system determines the result of the promotional feature based on the player interactions. For example, the gaming system may determine the result of the promotional feature by detecting the outcome of a promotional game event included in the promotional feature. The result of the promotional feature may also be determined based on player interaction with just the promotional feature. For example, how long the player watches a tutorial included in the promotional feature, how many interactions of the interactive demo the player completes, and the like. At 506, the result of the interaction with the promotional feature are then compared with a preset criterion to determine if a promotional award for the promotional feature should be distributed. Promotional game events may be skills based and or chance based and different promotional game events may have different criteria for distributing promotional awards. For example, the criteria for awarding promotional awards for a skill-based promotional game event may be the exhibition of a requisite amount of skill during gameplay of the skills based game event. Criteria for awarding promotional awards may also include coin-in thresholds, time spent on an electronic gaming device, number of times wagered, and the like. There may be one or more different promotional awards that can be satisfied by one or more preset criterion. Criteria for distributing promotional awards may be associated with player determinate metrics (e.g., unique player tracking number and other personal identification information) found, for example, on a player ID card. Players satisfying one or more criteria can be selected by the gaming system for new and unique promotions.

If the preset criteria is satisfied at 506, the gaming system may distribute the promotional award at 508. If the preset criteria is not satisfied at 506, the gaming system may not distribute one or more promotional awards and may request a wager at 510 to begin game play of the wagering game. The promotional award for promotional features may include monetary and/or non-monetary awards. Non-monetary awards may include, for example, the display of one or more aspects of a tutorial and/or game play for a playable demo. The promotional award may also include hints, tips, tricks, or other benefits and/or advantages for a game event and/or secondary game event. Monetary awards included in the promotional award may include, for example, credits that a player may use to place wagers in a game event of the primary game and/or redeem for cash. Monetary awards may also include free promotional play credits for use in the wagering game. The free promotional play credits may be used to place wagers in the wagering game and, in various embodiments, may not be redeemed for cash. Promotional awards may also effect game play of the wagering game and/or payouts provided by the wagering game. For example, promotional awards may increase the probability of achieving a successful outcome in one or more game events. Promotional awards may also increase the return to player (RTP) and/or payouts for winning outcomes in the wagering game.

The promotional award may be quantifiable, such as an amount of credit being awarded to a credit balance after an initial credit balance, a number of free play credits for placing wagers, the percent increase in probability of achieving a successful outcome, and the like. The promotional award may also be non-quantifiable, such as an opportunity to experience or learn more about a primary game. For example, the promotional award may allow the player to experience a portion of a primary game including one or more skills-based aspects. Therefore, interacting with the promotional feature may enable a player to experience game play aspects of the wagering game and gain some skill in skills based game events prior to playing the game with credit at risk. The promotional award may also provide additional opportunities to learn about game play aspects and game strategy through a tutorial included in the promotional feature. Once the promotional awards are distributed at 508, the gaming system may display one or more graphics and/or animations on the electronic gaming machine indicating that the promotional award has been distributed.

In order to distribute promotional awards, the gaming system may require satisfaction of one or more eligibility requirements and/or award conditions. In response to distributing the promotional award, the gaming system may display instructions on eligibility for the promotional award upon satisfaction of certain award conditions. At 512, the gaming system may determine if one or more eligibility requirements for receiving promotional awards are satisfied. The award conditions may include a minimum age and/or the gaming system's ability to identify a player. For example the gaming system, may require the player provide a player loyalty card or other player identification card before distributing the promotional award. Establishing a credit balance to play the wagering game and/or placing a wager on a game event included in the wagering game may also be a condition for distributing the promotional award. If a player does not input money or otherwise establish a credit balance to play the wagering game, after interacting with the promotional feature, the gaming system may not distribute the promotional award. The gaming system may also not distribute the promotional award if the player does not palace a wager on a game event even after the player established a credit balance.

Other requirements for distributing a potential award may include finishing a promotional feature of the promotional feature being no longer available for interaction. For example, the promotional feature will no longer be made available upon the player actuating a game session of the wagering game at the electronic gaming machine. The promotional award may also only be available to the player at the electronic gaming machine immediately after and/or within a preset time period after the player interacts with the promotional feature. The eligibility of a player to receive a promotional award may also depend on the player's assigned status with the gaming system operator or the number of loyalty points a player has received through use of their player loyalty card. Eligibility information may be managed by the player tracking system and determined upon the player identifying themselves at the gaming machine. An eligible player will receive the promotional award whereas a non-eligible player will not receive the promotional award. Award conditions and player eligibility requirements may be displayed on the display of the electronic gaming machine to notify players of the conditions for receiving a promotional award and to promote play of the wagering game using the promotional award.

Once the player receives the promotional award the player may use the promotional award at 514. For example, the player may use credits and/or free credits distributed as a promotional award to place a wager on a game event. Responsive to receiving a wager, the player's credit balance may be decreased by the amount of the wager being debited from the credit balance. The wager may be placed pursuant to actuation of a wager input signal by the player through a button or virtual representation thereof. At 516, in response to receiving a player input, such as a wager, the electronic gaming machine may initiate a game event. The game event may include an activity within a game instance. Game events may include game play activities within a wide variety of chance and/or skill games. For example, a game event may include one or more selections in a slot game, one or more hands in card game, such as poker, one or more shots in a shooting game, such as dart throws in a dart game, a period of gameplay in a sports or e-sports game, and the like.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. The embodiments were chosen and described in order to best explain the principles of the disclosure and its practical applications, to thereby enable others skilled in the art to best utilize the disclosure and various embodiments with various modifications as are suited to the particular use contemplated.

The system and method disclosed herein may be implemented via one or more components, systems, servers, appliances, other subcomponents, or distributed between such elements. When implemented as a system, such systems may include an/or involve, inter alia, components such as software modules, general-purpose CPU, RAM, etc. found in general purpose computers. In implementations where the innovations reside on a server, such a server may include or involve components such as CPU, RAM, etc., such as those found in general-purpose computers.

Additionally, the system and method herein may be achieved via implementations with disparate or entirely different software, hardware and/or firmware components, beyond that set forth above. With regard to such other components (e.g., software, processing components, etc.) and/or computer-readable media associated with or embodying the present inventions, for example, aspects of the innovations herein may be implemented consistent with numerous general purpose or special purpose computing systems or configurations. Various exemplary computing systems, environments, and/or configurations that may be suitable for use with the innovations herein may include, but are not limited to: software or other components within or embodied on personal computers, servers or server computing devices such as routing/connectivity components, handheld or laptop devices, multiprocessor systems, microprocessor-based systems, set top boxes, consumer electronic devices, network PCs, other existing computer platforms, distributed computing environments that include one or more of the above systems or devices, etc.

In some instances, aspects of the system and method may be achieved via or performed by logic and/or logic instructions including program modules, executed in association with such components or circuitry, for example. In general, program modules may include routines, programs, objects, components, data structures, etc. that perform particular tasks or implement particular instructions herein. The inventions may also be practiced in the context of distributed software, computer, or circuit settings where circuitry is connected via communication buses, circuitry or links. In distributed settings, control/instructions may occur from both local and remote computer storage media including memory storage devices.

The software, circuitry and components herein may also include and/or utilize one or more type of computer readable media. Computer readable media can be any available media that is resident on, associable with, or can be accessed by such circuits and/or computing components. By way of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic tape, magnetic disk storage or other magnetic storage devices, or any other medium which can be used to store the desired information and can accessed by computing component. Communication media may comprise computer readable instructions, data structures, program modules and/or other components. Further, communication media may include wired media such as a wired network or direct-wired connection, however no media of any such type herein includes transitory media. Combinations of the any of the above are also included within the scope of computer readable media.

In the present description, the terms component, module, device, etc. may refer to any type of logical or functional software elements, circuits, blocks and/or processes that may be implemented in a variety of ways. For example, the functions of various circuits and/or blocks can be combined with one another into any other number of modules. Each module may even be implemented as a software program stored on a tangible memory (e.g., random access memory, read only memory, CD-ROM memory, hard disk drive, etc.) to be read by a central processing unit to implement the functions of the innovations herein. Or, the modules can comprise programming instructions transmitted to a general purpose computer or to processing/graphics hardware via a transmission carrier wave. Also, the modules can be implemented as hardware logic circuitry implementing the functions encompassed by the innovations herein. Finally, the modules can be implemented using special purpose instructions (SIMD instructions), field programmable logic arrays or any mix thereof which provides the desired level performance and cost.

As disclosed herein, features consistent with the disclosure may be implemented via computer-hardware, software and/or firmware. For example, the systems and methods disclosed herein may be embodied in various forms including, for example, a data processor, such as a computer that also includes a database, digital electronic circuitry, firmware, software, or in combinations of them. Further, while some of the disclosed implementations describe specific hardware components, systems and methods consistent with the innovations herein may be implemented with any combination of hardware, software and/or firmware. Moreover, the above-noted features and other aspects and principles of the innovations herein may be implemented in various environments. Such environments and related applications may be specially constructed for performing the various routines, processes and/or operations according to the invention or they may include a general-purpose computer or computing platform selectively activated or reconfigured by code to provide the necessary functionality. The processes disclosed herein are not inherently related to any particular computer, network, architecture, environment, or other apparatus, and may be implemented by a suitable combination of hardware, software, and/or firmware. For example, various general-purpose machines may be used with programs written in accordance with teachings of the invention, or it may be more convenient to construct a specialized apparatus or system to perform the required methods and techniques.

Aspects of the method and system described herein, such as the logic, may also be implemented as functionality programmed into any of a variety of circuitry, including programmable logic devices ("PLDs"), such as field programmable gate arrays ("FPGAs"), programmable array logic ("PAL") devices, electrically programmable logic and memory devices and standard cell-based devices, as well as application specific integrated circuits. Some other possibilities for implementing aspects include: memory devices, microcontrollers with memory (such as EEPROM), embedded microprocessors, firmware, software, etc. Furthermore, aspects may be embodied in microprocessors having software-based circuit emulation, discrete logic (sequential and combinatorial), custom devices, fuzzy (neural) logic, quantum devices, and hybrids of any of the above device types. The underlying device technologies may be provided in a variety of component types, e.g., metal-oxide semiconductor field-effect transistor ("MOSFET") technologies like complementary metal-oxide semiconductor ("CMOS"), bipolar technologies like emitter-coupled logic ("ECL"), polymer technologies (e.g., silicon-conjugated polymer and metal-conjugated polymer-metal structures), mixed analog and digital, and so on.

It should also be noted that the various logic and/or functions disclosed herein may be enabled using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, non-volatile storage media in various forms (e.g., optical, magnetic or semiconductor storage media) though again does not include transitory media. Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Although certain presently preferred implementations of the system and method have been specifically described herein, it will be apparent to those skilled in the art to which the disclosure pertains that variations and modifications of the various implementations shown and described herein may be made without departing from the spirit and scope of the disclosure.

While the foregoing has been with reference to a particular embodiment of the disclosure, it will be appreciated by those skilled in the art that changes in this embodiment may be made without departing from the principles and spirit of the disclosure, the scope of which is defined by the appended claims.

What is claimed is:

1. A computer implemented method for providing an attract mode that encourages game play on an electronic gaming device, the method comprising:

actuating, by an electronic gaming machine, an attract mode based on detecting an inactivity of the electronic gaming machine, the attract mode including a promotional feature;

displaying, on a display of the electronics gaming machine, one or more attract mode features;

receiving, through an input device of the electronic gaming machine, a player interaction with the one or more attract mode features;

actuating, by the electronic gaming machine, a promotional feature based on the player interaction with the one or more attract mode features, wherein the promotional feature includes a game play activity;

displaying, on a display of the electronic gaming machine, one or more graphics or animations during an instance of play of the game play activity;

receiving, through the input device of the electronic gaming machine, a player interaction with the promotional feature that completes the instance of play of the game play activity;

determining, by the electronic gaming machine, a result for the promotional feature based on the player interaction with the promotional feature during the game play activity;

distributing a promotional award based on a comparison of the result to a criterion; and receiving the promotional award as a wager that initiates an instance of continuous game play on the electronic gaming machine.

2. The method of claim 1, further comprising:

receiving, through the input device of the electronic gaming machine, a wager input from a player to the electronic gaming machine;

in response to receiving the wager, generating a game event including a game play activity;

receiving, through the input device of the electronic gaming machine, the promotional award; and in response to receiving the promotional award, modifying, by the electronic gaming machine, the game event based on the promotional award.

3. The method of claim 2, wherein the promotional award provides the player an advantage during the game play activity that helps the player achieve a successful outcome for the game event.

4. The method of claim 1, further comprising:

receiving, through the input device of the electronic gaming machine, a wager input from a player to an electronic gaming machine;

in response to receiving the wager, generating a game event including a game play activity;

receiving, through the input device of the electronic gaming machine, the promotional award; and in response to receiving the promotional award, modifying, by the electronic gaming machine, the wager based on the promotional award.

5. The method of claim 4, wherein the promotional award increases the wager to increase the payout for a achieving a successful outcome of the game event.

6. The method of claim 1, wherein the game play activity included in the promotional feature is a skill-based game play activity; and the criterion relates to an amount of skill a player demonstrates while performing the skill-based game play activity.

7. The method of claim 6, further comprising:

displaying, by the electronic gaming machine, one or more graphics or animations during an instance of play of the skill-based game play activity, wherein the player interprets the one or more graphics or animations to determine when to interact with the electronic gaming machine to complete the instance of play of the skill-based game play activity.

8. The method of claim 1, wherein the game play activity included in the promotional feature is a chance based activity; and the criterion relates to an occurrence of a random event.

9. The method of claim 1, further comprising: selecting, by the electronic gaming machine, a condition for distributing the promotional award;

determining, by the electronic gaming machine, the player satisfies the condition; and in response to determining the condition is satisfied, making, by the electronic gaming machine, the promotional award available for use.

10. The method of claim 1, further comprising:

displaying, by the electronic gaming machine, an animation or graphic to the player corresponding to the promotional award.

11. An electronic gaming apparatus configured to provide an attract mode that encourages game play on the electronic gaming apparatus, the electronic gaming apparatus comprising:

a processor and a memory connected to each other;

a display connected to the processor;

an input device connected to the processor;

a plurality of lines of instructions stored in the memory and executed by the processor that is configured to:

actuate, by the electronic gaming apparatus, an attract mode based on detecting an inactivity of the electronic gaming apparatus, the attract mode including a promotional feature;

display, on the display, one or more attract mode features;

receive, through the input device, a player interaction with the one or more attract mode features of the attract mode;

actuate, by the electronic gaming apparatus, a promotional feature based on the player interaction during the attract mode, wherein the promotional feature includes a game play activity;

display, on the display, one or more graphics or animations during an instance of play of the game play activity;

receive, through the input device, a player interaction with the promotional feature that completes the instance of play of the game play activity;

determine, by the electronic gaming apparatus, a result for the promotional feature based on the player interaction with the promotional feature during the game play activity;

distribute a promotional award based on a comparison of the result to a criterion; and receive the promotional award as a wager that initiates an instance of continuous game play on the electronic gaming machine.

12. The apparatus of claim 11, wherein the processor is further configured to;

receive, through the input device, a wager input from a player to the electronic gaming apparatus;

in response to receiving the wager, generate a game event including a game play activity;

receive, through the input device, the promotional award; and in response to receiving the promotional award, modify, by the electronic gaming apparatus, the game event based on the promotional award.

13. The apparatus of claim 12, wherein the promotional award provides an advantage during the game play activity that helps a player achieve a successful outcome for the game event.

14. The apparatus of claim 11, wherein the processor is further configured to:

receive, through the input device, a wager input from a player to the electronic gaming apparatus;

in response to receiving the wager, generate a game event including a game play activity;

receive, through the input device, the promotional award; and in response to receiving the promotional award, modify, by the electronic gaming apparatus, the wager based on the promotional award.

15. The apparatus of claim 14, wherein the promotional award increases an amount of the wager to increase a payout for a achieving a successful outcome of the game event.

16. The apparatus of claim 11, wherein the game play activity included in the promotional feature is a skill-based game play activity; and the criterion relates to an amount of skill a player demonstrates while performing the skill-based game play activity.

17. The apparatus of claim 16, wherein the processor is further configured to:

display, by the electronic gaming apparatus, one or more graphics or animations during an instance of play of the skill-based game play activity, wherein the player interprets the one or more graphics or animations to determine when to interact with the electronic gaming apparatus to complete the instance of play of the skill-based game play activity.

18. The apparatus of claim 11, wherein the game play activity included in the promotional feature is a chance based activity; and the criterion relates to an occurrence of a random event.

19. The apparatus of claim 11, wherein the processor is further configured to:

select, by the electronic gaming apparatus, a condition for distributing the promotional award;

determine, by the electronic gaming apparatus, the player satisfies the condition; and in response to determining the condition is satisfied, make, by the electronic gaming apparatus, the promotional award available for use.

20. The apparatus of claim 11, wherein the processor is further configured to: display, by the electronic gaming apparatus, an animation or graphic to the player corresponding to the promotional award.

* * * * *